United States Patent [19]

Juds

[11] Patent Number: 4,990,895

[45] Date of Patent: Feb. 5, 1991

[54] METHOD AND APPARATUS FOR TESTING PHOTOELECTRIC CIRCUITS

[75] Inventor: Scott M. Juds, Everett, Wash.

[73] Assignee: Opcon, Inc., Everett, Wash.

[21] Appl. No.: 351,793

[22] Filed: May 15, 1989

Related U.S. Application Data

[63] Continuation-in-part of Ser. No. 222,562, Jul. 21, 1988, abandoned.

[51] Int. Cl.[5] ..... G08B 21/00

[52] U.S. Cl. ..... 340/635; 340/540

[58] Field of Search ..... 340/635, 641, 642, 644, 340/540; 250/221, 222.1, 526; 324/158 D, 158 R

[56] References Cited

U.S. PATENT DOCUMENTS

| | | | |
|---|---|---|---|
| 4,099,178 | 7/1978 | Ranney et al. | 340/515 |
| 4,156,883 | 5/1979 | Walter | 361/177 |
| 4,309,696 | 1/1982 | Nagai et al. | 340/515 |
| 4,566,008 | 1/1986 | Powers et al. | 340/941 |
| 4,706,561 | 11/1987 | Greer | 340/664 X |
| 4,797,548 | 1/1989 | Köbbing et al. | 250/221 |
| 4,823,901 | 4/1989 | Harding | 250/221 X |

*Primary Examiner*—Joseph A. Orsino
*Assistant Examiner*—Jeffery A. Hofsass
*Attorney, Agent, or Firm*—Christensen, O'Connor, Johnson & Kindness

[57] ABSTRACT

The operability of a photoelectric sensor is tested by creating both an ON TEST and an OFF TEST. During the ON TEST a test light source, such as a light-emitting diode (LED), located in the vicinity of the light-detecting elements of the photoelectric sensor, is enabled to be energized. Alternatively, the light-detecting elements of the photoelectric sensor are by-passed and the output of the light-detecting elements directly energized. The ON TEST LED (or the by-pass) is interconnected with the circuit that controls the energization of the normal or operational light source(s) of the photoelectric sensor such that the ON TEST LED will only ignite (or the by-pass will only operate) if current flows through the operational light source(s). If the operational light source(s) are damaged and, thus, current cannot flow, the ON TEST LED will not light (or the by-pass will not produce an energizing voltage). A fault is indicated if the sensor output does not indicate the detection of light when the ON TEST is being conducted. In essence, the ON TEST creates (or simulates) light detection regardless of whether an object is located between the operational light source(s) and the light-detecting element(s) of the photoelectric sensor. During the OFF TEST, current flow through the operational light source(s) is inhibited. As a result, the light-detecting elements of the photoelectric sensor do not receive light. A fault indication is provided if the sensor output indicates the detection of light when the OFF TEST is being conducted.

44 Claims, 4 Drawing Sheets

METHOD AND APPARATUS FOR TESTING PHOTOELECTRIC CIRCUITS

CROSS-REFERENCE TO RELATED APPLICATION

This application is a continuation-in-part of U.S. patent application No. 07/222,562, filed July 21, 1988, now abandoned and entitled "Method And Apparatus For Testing Photoelectric Circuits."

TECHNICAL AREA

This invention relates to photoelectric sensors and, more particularly, to methods and apparatus for testing the operability of photoelectric sensors.

BACKGROUND OF THE INVENTION

In the past, photoelectric sensors, i.e., sensors that include one or more light-emitting devices, such as light-emitting diodes (LEDs), and one or more light-detecting devices, such as photodiodes, have not included a means to verify the operation of the sensing circuitry of the sensor. While undesirable, this lack is not particularly dangerous when photoelectric sensors are used to detect the presence or absence of objects on assembly lines and the like. However, as the use of photoelectric sensors has extended to other areas, such as the automatic guided vehicle (AGV) area, the inability to determine whether the sensing circuitry of photoelectric sensors is operating satisfactorily has become a more significant problem. The problem is of more concern because failure of the sensing circuitry of a photoelectric sensor in an AGV can result in damage to, or injury of, the associated mechanism, i.e., the AGV, and nearby items that the AGV can't "see".

This invention is directed to solving the foregoing problem by providing a method and apparatus for testing the operability of photoelectric sensor circuits. The nature of the invention is such that it can be readily "built into" a photoelectric sensor, either as part of an integral circuit that includes the photoelectric sensor circuitry, or as part of a separate test integrated circuit.

SUMMARY OF THE INVENTION

In accordance with this invention, a method and apparatus for testing the operability of a photoelectric sensor is provided. The method and apparatus performs an ON TEST and an OFF TEST. During the ON TEST, a test light source, such as a light-emitting diode (LED), located in the vicinity of the light-detecting element(s) of the photoelectric sensor, is enabled to be energized. Alternatively, the light-detecting elements of the photoelectric sensor can be by-passed and the output of the light-detecting elements directly energized. The ON TEST LED (or the by-pass) circuit is interconnected with the circuit that controls the energization of the normal or operational light source(s) of the photoelectric sensor such that the ON TEST LED will only ignite (or the by-pass circuit will only operate) if current flows through the operational light source(s). If the operational source(s) are damaged and, thus, current cannot flow, the ON TEST LED will not light (or the by-pass circuit will not produce an energizing voltage). A fault is indicated if the sensor output does not indicate the detection of light when the ON TEST is being conducted. During the OFF TEST, current flow through the operational light source(s) is inhibited. As a result, the light-detecting elements of the photoelectric sensor do not receive light. A fault is thus indicated if the sensor output indicates the detection of light when the OFF TEST is being conducted. In essence, the ON TEST creates (or simulates) light detection regardless of whether an object is located between the light source(s) and the light-detecting element(s) of the photoelectric sensor and the OFF TEST creates detection termination.

In accordance with other aspects of this invention, in addition to the ON TEST LED, the ON TEST circuit includes first and second semiconductor switches connected in circuit with the ON TEST LED. One of the semiconductor switches is enabled when the ON TEST is to be performed. The other semiconductor switch is enabled when current flows through the normal or operational light source(s). Alternatively, a by-pass ON TEST circuit includes a semiconductor switch that normally is enabled to short the energy that directly energizes the output of the light-detecting elements. During an ON TEST the semiconductor switch is disabled. During an ON TEST, i.e., when the semiconductor switch is disabled, the inability of current flow through the normal or operational light sources prevents the source of the energy that directly energizes the output of the light-detecting elements from reaching a level adequate to cause the sensor to indicate the detection of light.

In accordance with other aspects of this invention, the OFF TEST portion of the test circuit includes a semiconductor switch connected in circuit with the light source(s) of the photoelectric sensor. Normally the OFF TEST semiconductor switch is enabled to allow current to flow through the light source(s) of the photoelectric sensor. When the OFF TEST is being performed, the semiconductor switch is disabled to prevent the flow of current through the light source(s) of the photoelectric sensor.

As will be readily appreciated from the foregoing summary, the photoelectric built-in test circuit of the invention tests both the flow of current through the light source(s) of the photoelectric sensor being tested and the ability of the photoelectric sensor to respond to artificially created light situations. If current cannot flow through the light source(s) due to a fault therein, or if the photoelectric sensor circuit does not correctly respond to the artificially created light situations, a fault is denoted.

BRIEF DESCRIPTION OF THE DRAWINGS

The foregoing and other features and advantages of the present invention will become more readily appreciated as the same becomes better understood by reference to the following detailed description when taken in conjunction with the accompanying drawings wherein.

DESCRIPTION OF THE PREFERRED EMBODIMENT

Figure 1:
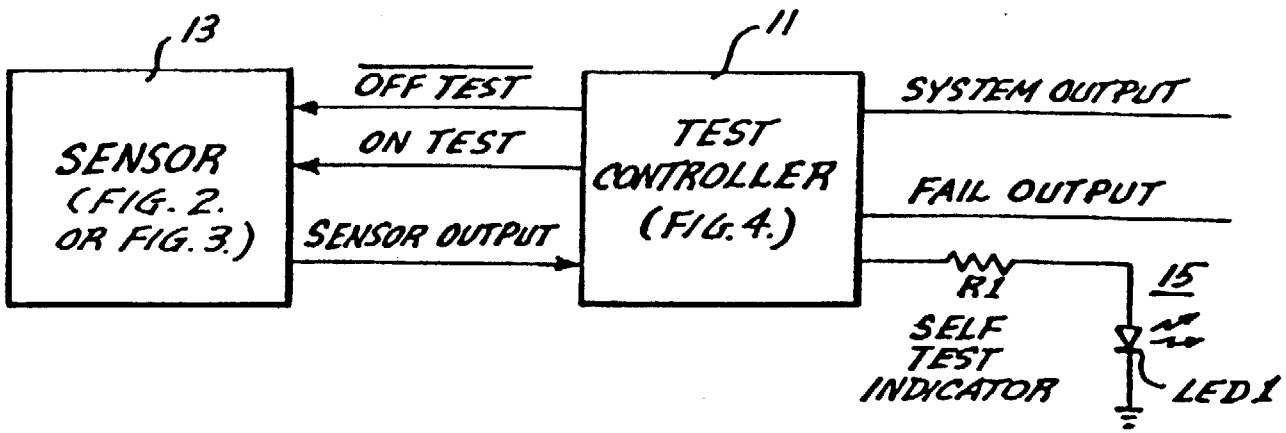
FIG. 1 is a block diagram of a photoelectric built-in test circuit formed in accordance with the invention.

As depicted in FIG. 1, a photoelectric built-in test circuit formed in accordance with the invention comprises a test controller 11 connected to a photoelectric sensor 13. In operation, the test controller produces ON TEST or OFF TEST signals whose states determine the open and closed state of switches connected in circuit with the normal sensing circuit of the sensor 13. When a test is being performed, the system output of the test controller is latched to the state of the sensor output that existed when the test started. In addition to the system output, the test controller includes a fail output whose binary state denotes whether the sensor passed the ON and OFF TESTs. Further, preferably, the test controller 11 produces a binary output whose state controls the emission of light by a self-test indicator 15. Preferably the self-test indicator includes a light-emitting diode, designated LED 1, connected in series with a resistor, designated R1, between the output of the test controller 11 and ground. The self-test indicator, i.e., LED 1, is lit when ON or OFF TESTs are being performed by the test controller 11 and stays on as long as a failed condition persists.

Figure 2:
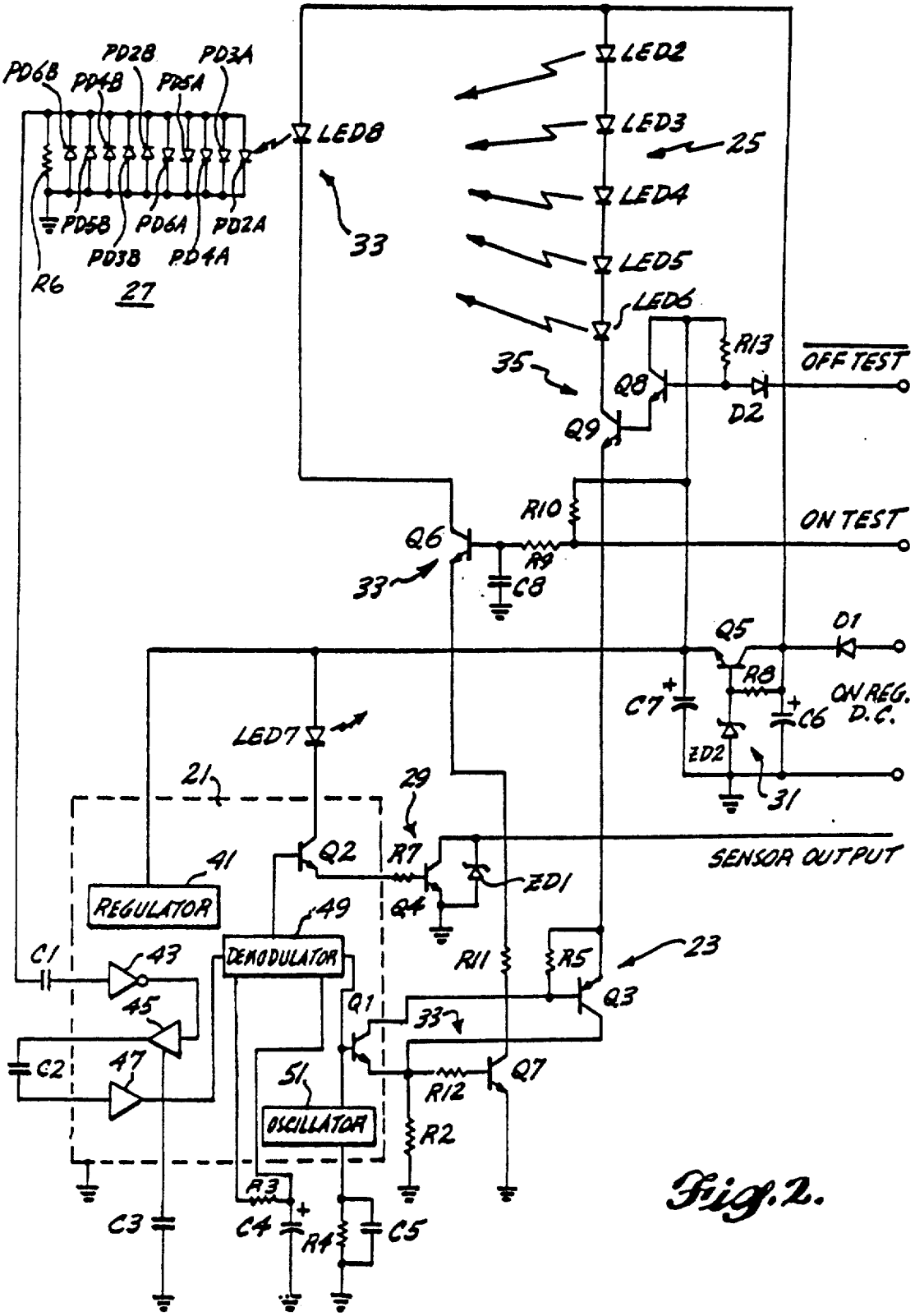
FIG. 2 is a schematic diagram of the sensor portion of the photoelectric built-in test circuit illustrated in FIG. 1.

The sensor illustrated in FIG. 2 generally comprises: a sensor control circuit 21; a light source driver circuit 23; a light source circuit 25; a light detector circuit 27; an output circuit 29; a voltage regulator 31; an ON TEST circuit 33; and, an OFF TEST circuit 35. The sensor control circuit 21 is illustrated in functional block form. The sensor control circuit can be implemented in discrete circuit form or, more preferably, the major elements can be implemented in integrated circuit form as shown by the dashed outline in FIG. 2. Since the sensor control circuit, per se, does not form a part of this invention, only the major components of a control circuit are illustrated within the dashed outline in FIG. 2 and described here. The illustrated part of the sensor control circuit 21 shown within the dashed outline includes: a regulator 41; an amplifier chain comprising an inverting amplifier 43 and two signal amplifiers 45 and 47; a demodulator 49; an oscillator 51; and a pair of NPN output transistors, designated Q1 and Q2. A coupling capacitor, designated C1, couples the output of the light detector circuit 27 (described below) to the input of the inverting amplifier 43. The output of the inverting amplifier 43 is connected to the input of the first signal amplifier 45. The output of the first signal amplifier 45 is coupled via a second capacitor, designated C2, to the input of the second signal amplifier 47. Further, the first signal amplifier 45 is connected to ground via a third capacitor, designated C3. C1, C2 and C3 form bandwidth limiting filter capacitors that block DC and pass AC.

The output of the second signal amplifier 47 is connected to one input of the demodulator 49. The output of the oscillator 51 is connected to the second input of demodulator 49 and to the base of Q1. The emitter of Q1 is connected to ground via a second resistor, designated R2. Further, the demodulator 49 is connected to ground through a fourth capacitor, designated C4. The ungrounded end of the fourth capacitor is also connected, via a third resistor, designated R3, to the demodulator 49. In a conventional manner, R3 and C4 control the integration response time of the demodulator 49. The oscillator 51 is connected to ground through a parallel circuit formed by a fourth resistor, designated R4, and a fifth capacitor, designated C5. R4 and C5 control the frequency and duty cycle of the signal produced by the oscillator 51. The signal output of the demodulator 49 is connected to the base of Q2. The regulator 41 is connected to the voltage regulator 31 in the manner described below.

As will be better understood from the following description, Q1 produces a modulated output signal that controls the emission of light by the light source circuit 25. The light emissions of the light source circuit 25 are detected by the light detector circuit 27, which produces a signal that is coupled to one input of the demodulator 49 by the circuit components described above, i.e., C1, the inverting amplifier 43, C2 and the first and second signal amplifiers 45 and 47. The demodulator demodulates the output produced by the light detector circuit synchronously with the signal produced by the oscillator 51. As will be readily appreciated by those familiar with the photoelectric sensor art, the end result of this arrangement is a modulated photosensor system.

The source driver circuit 23 comprises: a PNP power transistor designated Q3; and a resistor designated R5. The collector of Q1 is connected to the base of Q3. R5 is connected between the emitter and base of Q3. The collector of Q3 is connected to the junction between R2 and the emitter of Q1.

The illustrated light source circuit 25 comprises five light-emitting diodes designated LED 2, LED 3, LED 4, LED 5 and LED 6. LED 2-LED 6 are connected in series, i.e., anode to cathode, in numerical order. Further, the anode of LED 2 is connected to the input of the voltage regulator 31 in the manner hereinafter described. The cathode of LED 6 is connected via the OFF TEST circuit 35 to the emitter of Q3 in the manner described below.

The light detector circuit 27 comprises: five back-to-back connected unbiased photodiode pairs designated PD2A and B, PD3A and B, PD4A and B, PD5A and B and PD6A and B; and a sixth resistor, designated R6. The back-to-back connected photodiode pairs are all connected in parallel with one another and with R6. Back-to-back connected means that the diodes are connected in parallel in a back-to-back, i.e., cathode-to-anode, arrangement. One end of R6 and the associated anodes and cathodes of the back-to-back connected photodiode pairs are connected to ground and the other end of R6 and the associated anodes and cathodes are connected through C1 to the input of the inverting amplifier 43 that forms a portion of the sensor control circuit 21 described above. The unbiased photodiode combinations are positioned such that each pair responds to the light emitted by a corresponding one of the light-emitting diodes of the light source circuit 25, i.e., PD2A and B responds to light emitted by LED 2, PD3A and B responds to light emitted by LED 3, etc. For a more complete discussion of unbiased, back-to-back connected photodiode pairs, attention is directed to U.S. Pat. No. 4,015,117, entitled "Unbiased Modulated Photosensing Systems" by Joseph B. Wicklund, Jr., which is incorporated herein by reference.

The output circuit 29 comprises: a seventh resistor designated R7; an NPN power transistor designated Q4; and a zener diode designated ZD1. The emitter of Q2 is connected through R7 to the base of Q4. The emitter of Q4 is connected to ground. The anode of ZD1 is connected to ground and the cathode of ZD1 is connected to the collector of Q4. The collector of Q4 is also connected to a sensor output terminal. Since the base of Q2 responds to the output of the demodulator 49, the output circuit 29 forms a buffer power output transistor circuit for the demodulator output. ZD1 limits the voltage across the collector-emitter terminals of Q4 and, thereby, protects Q4 from destruction due to high-voltage spikes.

The voltage regulator 31 comprises: a diode designated D1; two capacitors designated C6 and C7; a zener diode designated ZD2; a resistor designated R8; and a regulating NPN transistor designated Q5. Ground and the anode of D1 are each connected to one output of an unregulated DC voltage source, i.e., a DC voltage source whose output fluctuates over what can be a relatively wide range—20 to 60 volts, for example. Specifically, the anode of D1 is connected to the positive output and ground is connected to the negative output of the voltage source. The cathode of D1 is connected to the collector of Q5 and through C6 to ground. The base of Q5 is connected to the cathode ZD2. The anode of ZD2 is connected to ground. R8 is connected between the base of Q5 and the collector of Q5. C7 is connected between the emitter of Q5 and ground. The emitter of Q5 is also connected to the regulator 41 of the sensor control circuit 21 and through a beam status light-emitting diode, designated LED 7, to the collector of Q2. More specifically, the emitter of Q5 is connected to the anode of LED 7 and the cathode of LED 7 is connected to the collector of Q2. In a conventional manner, the regulator circuit regulates the unregulated DC and provides a constant voltage output, which is applied to the collector of Q2 and to the internal regulator 41 of the sensor control circuit 21.

The ON TEST circuit 33 comprises: two NPN transistor switches designated Q6 and Q7; a capacitor designated C8; four resistors designated R9, R10, R11 and R12; and a test light-emitting diode designated LED 8. The ON TEST output of the test controller 11 is applied through R9 to the base of Q6. The base of Q6 is connected through C8 to ground. The ON TEST output of the test controller 11 is also connected through R10 to the regulated output of the voltage regulator 31, i.e., to the emitter of Q5. The unregulated input of the voltage regulator, specifically the voltage at the collector of Q5, is applied to both the anode of LED 2 and the anode of LED 8. The cathode of LED 8 is connected to the collector of Q6. The emitter of Q6 is connected through R11 to the collector of Q7. The emitter of Q7 is connected to ground. The junction between the emitter of Q1 and R2 is connected through R12 to the base of Q7. As will be better understood from the following description, both Q6 and Q7 must be enabled, i.e., conditioned to pass current, in order for LED 8 to emit light when an ON TEST is being performed.

The OFF TEST circuit 35 comprises: a pair of NPN transistors designated Q8 and Q9; a resistor designated R13; and a diode designated D2. The cathode of D2 is connected to the $\overline{\text{OFF TEST}}$ output of the test controller 11. (The bar over OFF TEST notes that the operative state of this signal is the low or binary zero state.) The anode of D2 is connected: to the base of Q8; through R13 to the collector of Q8. The collector of Q8 is also connected to the regulated output of the voltage regulator 31. The emitter of Q8 is connected to the base of Q9. The collector of Q9 is connected to the cathode of LED 6. The emitter of Q9 is connected to the emitter of Q3.

Prior to describing the operation of the ON and OFF TEST circuits 33 and 35, a brief description of the normal operation of the photoelectric sensor 13 illustrated in FIG. 2 is described. When the $\overline{\text{OFF TEST}}$ output of the test controller 11 is high, which means no OFF TEST is being performed, Q9 is conditioned to pass current. As a result, as the oscillator 51 oscillates, Q1 switches Q3 on and off, allowing power to flow from the unregulated input of the voltage regulator 31 to ground via LED 2, LED 3, LED 4, LED 5, LED 6, Q9, Q3 and R2. As a result, modulated light is emitted by LED 2–LED 6. The light emitted by LED 2–LED 6 is detected by the unbiased pairs of back-to-back connected photodiodes PD2A and B–PD6A and B. As light is detected by the photodiode pairs, a modulated signal is applied to the demodulator 49. The modulated signal is demodulated and thresholded by the demodulator based on the oscillator 51 signal. The demodulated output is amplified by the output circuit 29. When an object moves into a position where it can be viewed by the photoelectric sensor, i.e., into a position that intersects both the radiation pattern of the LED beams and the field of view of the detector photodiodes, light from one or more LEDs is reflected back to one or more photodiodes, resulting in the demodulated signal level rising above the detection threshold level and a switching "on" of the demodulator output applied to the output circuit 29.

Turning now to the operation of the test circuits, regardless of whether an object is located at the intersection of the LED 2–LED 6 beams and the PD2A and B–PD6A and B field of view, when the ON TEST output of the test controller 11 shifts from a low state to a high state, Q6 is switched from a closed state to an open state. As a result, power from the unregulated input of the voltage regulator 31 is allowed to flow through LED 8, provided Q7 is enabled to pass current. Q7, like Q3, is switched open and closed by Q1 at the oscillator frequency. LED 8 is positioned such that the light it emits is adequate to cause the signal produced by PD2A and B–PD6A and B to create a positive response. LED 8 may, for example, be located in the housing that houses PD2A and B–PD6A and B. As a result, when LED 8 is lit, the photodiode pairs produce an output signal, which is demodulated by the demodulator 49 and creates a photosensor output signal. The photosensor output signal is analyzed by the test controller 11 in the manner hereinafter described.

If current cannot flow through the light-emitting diode string of the light source circuit 25, due to one or more of LED 2–LED 6 being inoperative, the voltage at the base of Q7, i.e., the voltage drop across R2 will not rise to a level adequate to switch Q7 on. As a result, the output of the photosensor circuit remains "off", i.e., no photosensor output signal is created during the ON TEST. Similarly, if the sensor control circuit 21 is partially or fully inoperative when the ON TEST takes place, the output of the photoelectric sensor 13 will not produce an output in response, i.e., the output will remain "off". Thus, the ON TEST establishes that the photoelectric sensor is operative and that the reason no "on" state output was being produced by the output circuit 29 is because no object in the sensor's field of view was reflecting light to the photodiodes, rather than because the photoelectric sensor circuitry was nonfunctional.

When the $\overline{\text{OFF TEST}}$ output of the test controller 11 goes low, current flow through LED 2–LED 6 is prevented as a result of Q9 being disabled. As a result, any prior detection, presumably caused by the presence of a reflective object in the sensor's field of view, should be terminated, thus turning "off" the output of the output circuit 29. In this way, the OFF TEST establishes that the photoelectric sensor is operative and that an object in the sensor's field of view, rather than a fault in the photoelectric sensor control circuit 21, was producing the "on" output of the output circuit 29.

Figure 3:
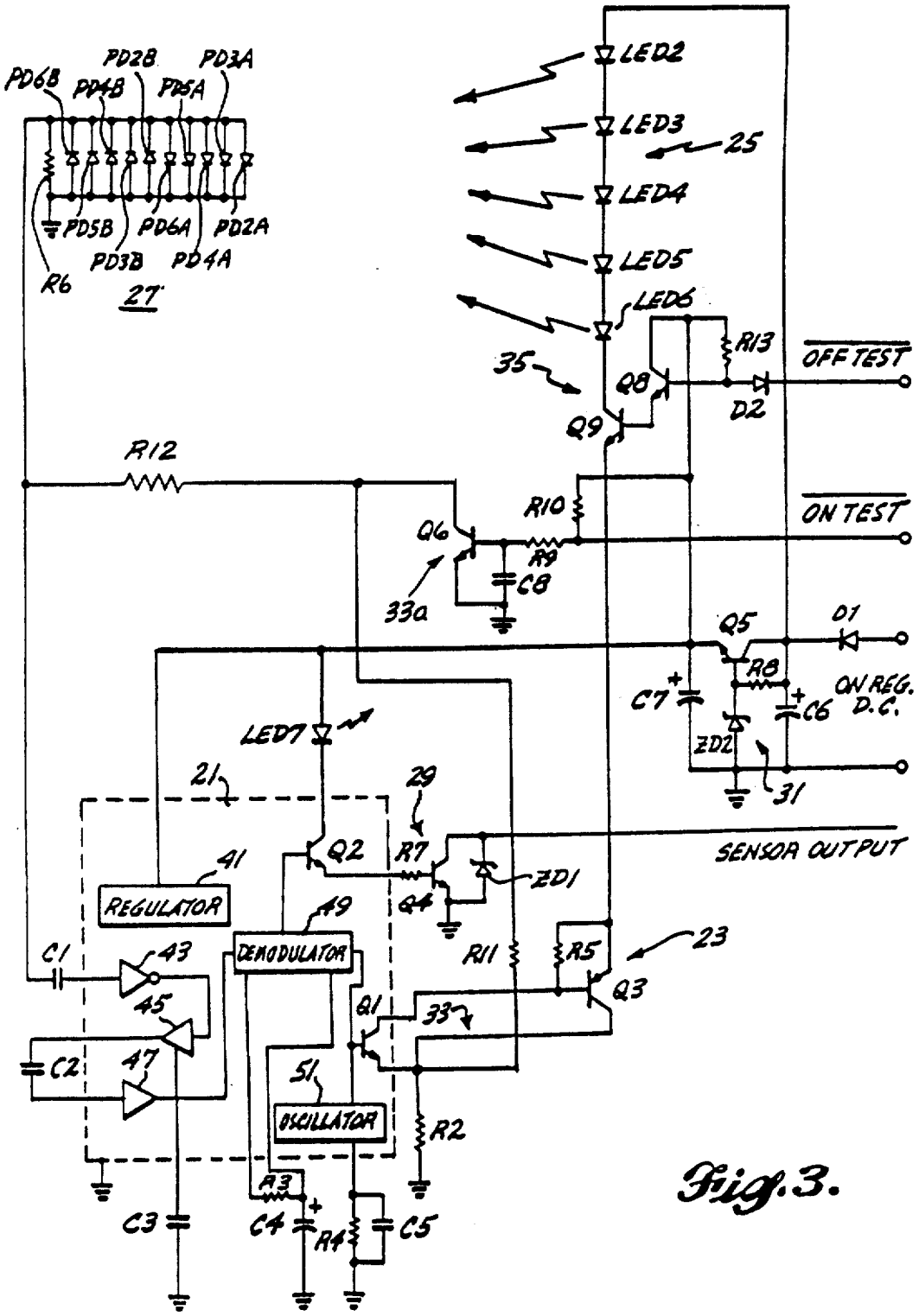
FIG. 3 is a schematic diagram of an alternate embodiment of the sensor portion of the photoelectric built-in test circuit illustrated in FIG. 1.

FIG. 3 illustrates a sensor including an alternate embodiment of an ON TEST circuit 33*a* formed in accordance with the invention. Since the OFF TEST circuit 35 and the remaining portion of the sensor are the same in FIGS. 2 and 3, they are not described. Further, only the differences between the FIG. 2 and 3 ON TEST circuits are described. In this regard, the FIG. 3 ON TEST circuit 33*a* does not include Q7 or LED 8. Further, R12 is moved. More specifically, rather than being connected to the emitter of Q7, the end of R11 remote from the emitter of Q6 is connected to the junction between the emitter of Q1 and R2. R12 is connected between the collector of Q6 and the junction between R6 and C1. Finally, the on test occurs when the ON TEST output of the test controller 11 goes low rather than when the ON TEST output of the test controller 11 goes high. This is shown in FIG. 3 by adding a bar above ON TEST.

In normal operation $\overline{\text{ON TEST}}$ is high, whereby Q6 is turned on. As a result, Q6 shorts the pulses produced at the emitter of Q1 to ground. Thus, these pulses are prevented from affecting the input of the sensor control circuit 21. When an on test is to occur, $\overline{\text{ON TEST}}$ shifts low, turning Q6 off. As a result, pulses produced at the emitter of Q1 are passed through R11 and R12 to the input of the sensor control circuit 21. Preferably, the combined resistance of R11 and R12 is in the 1 Mohm range. In any event, the pulses received by the sensor control circuit are processed in the manner previously described to create a sensor output if the sensor circuit is operating properly.

Like the ON TEST circuit 33 illustrated in FIG. 2, the ON TEST circuit 33*a* illustrated in FIG. 3 is only operable if current flows through the light-emitting diode string of the light source circuit 25. If light does not flow through the string due to one or more of LED 2–LED 6 being inoperative, the voltage across R2 does not reach a level adequate to be sensed at the input of the sensor control circuit 21. Obviously the FIG. 3 ON TEST circuit 33*a* does not test the photodiodes of the light detector circuit 27. Rather, the ON TEST circuit injects a signal into the light detector circuit 27 simulating the signal produced when suitable pulsed LED light is received by the photodiodes.

As will be readily appreciated from the foregoing description, in essence, the ON TEST artificially creates light detection whereas the OFF TEST artificially creates detection termination. As will be better understood from the following description of the test controller 11, when an ON TEST or OFF TEST is being performed, the photoelectric sensor output existing prior to the commencement of the test is latched to the output of the test controller so that downstream circuitry is unaffected by the test.

Figure 4:
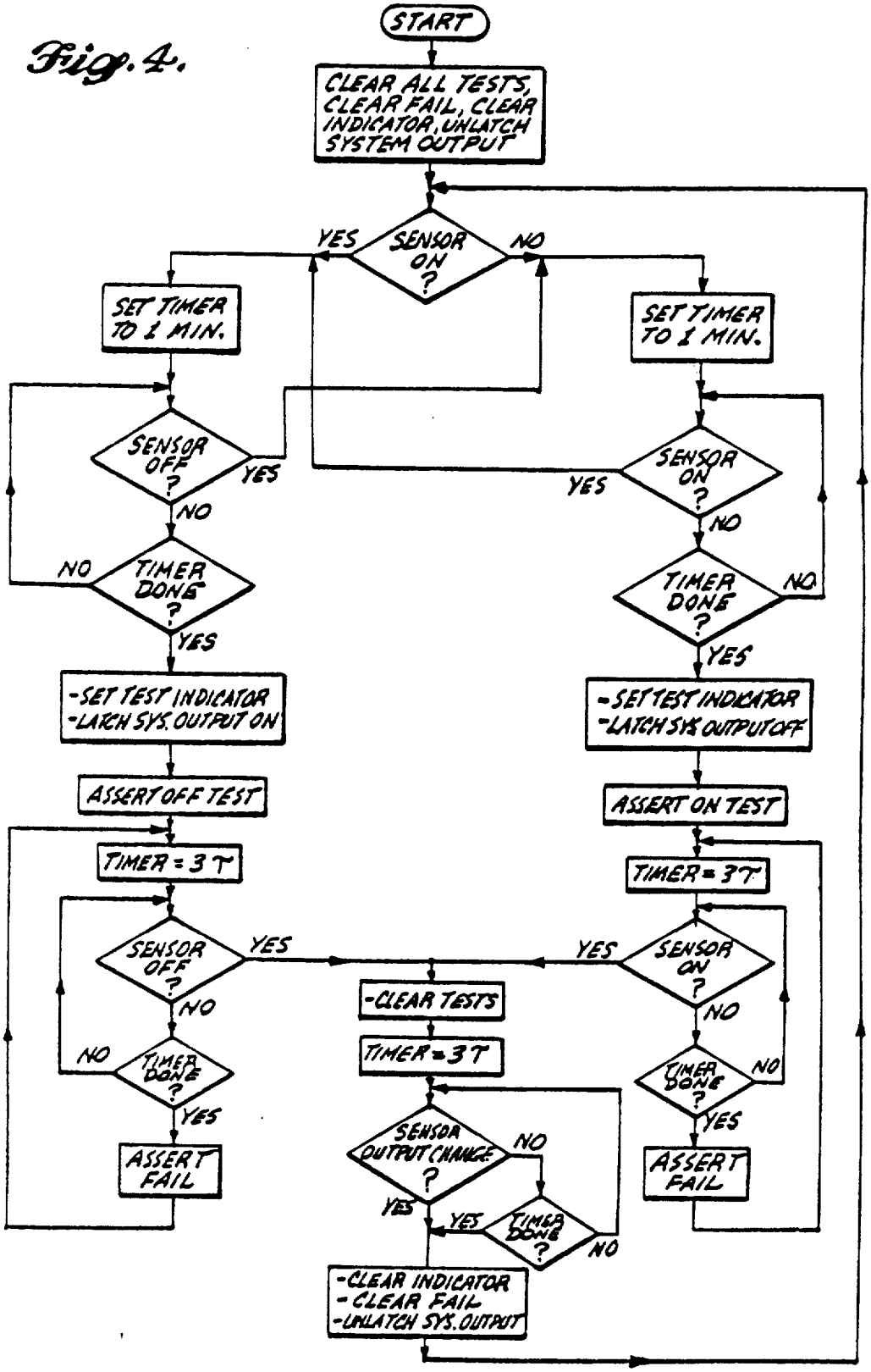
FIG. 4 is a flow diagram illustrating the operation of the test controller of the photoelectric built-in test circuits illustrated in FIGS. 1, 2, and 3.

FIG. 4 is a flow diagram illustrating the presently preferred manner of operation of a test controller 11 formed in accordance with the invention. The tests to be performed by the test controller can be performed at predetermined or random intervals. In any event, when the test sequence is started (at power up), the memory of the test controller is cleared; the fail and self-test indicator outputs (FIG. 1) are cleared; and the system output is unlatched, i.e., the system output is conditioned to track the sensor output. Thereafter, the sensor output is tested to determine if the sensor is ON (which denotes that the photodiodes are receiving light from the LEDs) or OFF (which denotes that the photodiodes are not receiving light from the LED). Depending upon the nature of the sensor output, one or the other of two paths located on the right and left side of FIG. 4 is followed.

The path on the right side is followed if the sensor if OFF. First, a timer is set equal to a predetermined interval—one minute, for example. Within this predetermined interval, the sensor output is repeatedly tested. The program cycles through this time-limited test loop until either the sensor output shifts from an OFF state to an ON state or the timer times out. If the sensor output shifts from an OFF state to an ON state before the timer times out, the program cycles to the left side of FIG. 4 and proceeds in the manner described below. If the timer times out before the sensor turns ON, the self-test indicator output of the test controller (FIG. 1) is set, i.e., shifts states, resulting in LED 1 being lit. In addition, the system output is latched to an OFF state, i.e., for the remainder of the test, the system output of the test controller signals that the sensor output is OFF regardless of whether the sensor output changes state in response to the following test. Next the ON TEST is asserted, i.e., the ON TEST output of the test controller shifts high if the ON TEST circuit is of the type illustrated in FIG. 2, enabling Q6 to allow current to flow to LED 8. Alternatively, if the ON TEST circuit is of the type illustrated in FIG. 3, the ON TEST output of the test controller shifts low, disabling Q6 to allow current to flow through R12 to the input of the sensor control circuit 21. Then a timer is set equal to a time interval equal to three times that of the response time ($\tau$) of the sensor. Within this predetermined time interval, the sensor output is repeatedly tested to determine if the sensor is ON or OFF. The program cycles through this time-limited loop unitl either the sensor output shifts to an ON state, or the timer times out. If the sensor output shifts to an ON state, the program cycles to a series of steps illustrated in the lower center of FIG. 3 and described below. If the timer times out before the sensor output shifts to an ON state, the fail output of the test controller is asserted, i.e., the fail output of the test controller shifts from a low state to a high state. Thereafter, the program cycles back to the point where the timer is set equal to three times the sensor response time and the program is repeated from this point. In essence, the ON TEST sequence is repeated.

If the sensor output is found to be ON after the initialization steps are completed, or, as noted above, if the sensor output shifts to an ON state before the one-minute timer times out, the program follows the sequence of steps illustrated on the left side of FIG. 4. The initial step in this sequence is to set the timer equal to a predetermined value, such as one minute. Within this predetermined interval, the sensor output is repeatedly tested to determine if it is ON or OFF. The program cycles through this time-limited test loop until either the sensor output shifts from an ON state to an OFF state or the timer times out. If the sensor output switches to an OFF state from an ON state prior to the timer timing out, the program cycles to the sequence of steps illustrated in the right side of FIG. 4 and described above. If the timer times out before the sensor output shifts to an OFF state, the self-test indicator is again set, whereby LED 1 is lit. In addition, the system output is latched to the ON state. For the remainder of the test sequence, the system output of the test controller denotes that the sensor output is ON. Changes in the sensor output occurring during the following test have no effect on the system output. Thereafter, the OFF TEST is asserted, i.e., the $\overline{\text{OFF TEST}}$ output of the test controller shifts to a low state whereby Q8 is disabled and prevents current flow through LED 2–LED 6 in the manner described above. The next step in the sequence illustrated on the left side of FIG. 4 is to set the timer equal to a time interval equal to three (3) times that of the sensor response time ($\tau$). Within this predetermined time interval, the output of the sensor is repeatedly tested to determine if the sensor is ON or OFF. The program cycles through this time-limited loop until either the sensor output shifts to an ON state, or the timer times out. If the sensor output does not shift from an OFF state to ON state before the timer times out, the fail output of the test controller 11 is asserted, i.e., shifts from a low state to a high state (or vice versa if the high state denotes the passing of the test). If the sensor output shifts from an ON state to an OFF state before the timer times out, the program cycles to the sequence of steps illustrated in the lower center of FIG. 4.

If the sensor output shifts to an OFF state during the OFF TEST or to an ON state during the ON TEST, the sensor has passed the tests and the program follows the sequence of steps illustrated in the lower center of FIG. 4. The first step in this sequence is to clear, i.e., unassert, the test control lines. Thereafter, the timer is set equal to three (3) times the sensor response time ($\tau$). Then the sensor output is evaluated to determine if it has changed. If the sensor output has not changed, the timer is tested to determine if it has timed out. If the timer has not timed out, the sensor output is again tested to determine if it has changed. The program cycles through this loop until either the timer times out or the sensor output changes. When either of these events occur, the self-test indicator output is cleared. As a result, LED 1 goes out. Simultaneously, the fail output of the test controller is cleared and the system output is unlatched. Thereafter, the system output tracks the sensor output. After these steps have taken place, the program cycles to the point where the first sensor ON test occurs, as illustrated in FIG. 4.

The steps illustrated in the center portion of FIG. 4, in essence, are designed to avoid the creation of an erroneous system output. More specifically, these steps are designed to give the sensor output a chance to stabilize to the condition actually being sensed by the sensor before the system output is unlatched. The failure to provide such a "settling" time delay could result in the system output manifesting a test output when the system output is unlatched, rather than an actual sensor output.

As will be readily appreciated from the foregoing description, the invention provides a test method and a test circuit designed to be built into a photoelectric sensor that tests the operability of the photoelectric sensor. The test circuit can be integrated with the sensor circuit in a single logic chip or incorporated in a separate chip. The test controller could be housed with the sensor or mounted in a separate housing. Further, the test controller could be part of a system controller housed remotely from the sensor. In either case, both the operation of the light-emitting and light-detecting elements of the sensor, or just the operations of the light-emitting elements, can be tested, as well as the sensor circuitry. The failure of any tested subsystem to operate satisfactorily will result in a fail indication. The fail indication can be used to control an audible or visual warning and/or system shutdown.

While a preferred embodiment of the invention has been illustrated and described, it is to be understood that various changes can be made therein without departing from the invention. Hence, within the scope of the appended claims, it is to be understood that the invention can be practiced otherwise than as specifically described herein.

The embodiments of the invention which an exclusive property or privilege is claimed are defined as follows:

1. A method of testing a photoelectric sensor that includes at least one operational light source and at least one light detector having, respectively, a light radiation pattern and a field of view aligned with one another for sensing the presence or absence of objects located in both said operational light radiation pattern and said light detector field of view and producing an output signal that is in a first state if light is detected by said light detector and a second state if light is not detected by said light detector, said method comprising the steps of:

controlling the output of said light detector so as to cause said photoelectric sensor to place said output signal in said first state if predetermined parts of said photoelectric sensor are operating correctly regardless of whether an object is located in both said operational light source light radiation pattern and said light detector field of view;

testing the output of said photoelectric sensor to determine if said output is in said first state; and controlling the state of a binary pass/fail output signal such that the binary pass/fail output signal is in a pass state if the output of said photoelectric sensor is in said first state when the output of said photoelectric sensor is tested and the binary pass/fail output signal is in a fail state if the output of said photoelectric sensor is not in said first state when the output of said photoelectric sensor is tested.

2. The method of testing a photoelectric sensor as claimed in claim 1, wherein said output of said light detector is controlled to cause said photoelectric sensor to place said output signal in said first state only if said operational light source is capable of emitting light.

3. The method of testing a photoelectric sensor as claimed in claim 2 including the further steps of:

preventing said operational light source from directly or indirectly applying light to said photoelectric detector to cause said photoelectric sensor to place said output signal in said second state;

testing the output of said photoelectric sensor to determine if said output is in said second state; and controlling the state of said binary pass/fail output signal such that the binary pass/fail output signal is in a pass state if the output of said photoelectric sensor is in said second state when the output of said photoelectric sensor is tested and the binary pass/fail output signal is in a fail state if the output of said photoelectric sensor is not in said second state when the output of said photoelectric sensor is tested.

4. The method of testing a photoelectric sensor as claimed in claim 1 including the further steps of:

preventing said operational light source from directly or indirectly applying light to said photoelectric detector to cause said photoelectric sensor to place said output signal in said second state;

testing the output of said photoelectric sensor to determine if said output is in said second state; and controlling the state of said binary pass/fail output signal such that the binary pass/fail output signal is in a pass state if the output of said photoelectric sensor is in said second state when the output of said photoelectric sensor is tested and the binary pass/fail output signal is in a fail state if the output of said photoelectric sensor is not in said second state when the output of said photoelectric sensor is tested.

5. The method of testing a photoelectric sensor as claimed in claim 1, wherein the step of controlling the output of said light detector so as to cause said photoelectric sensor to place said output signal in said first state comprises applying a test light to said light detector.

6. The method of testing a photoelectric sensor as claimed in claim 5, wherein said test light is applied to said light detector to cause said photoelectric sensor to place said output signal in said first state only if said operational light source is capable of emitting light.

7. The method of testing a photoelectric sensor as claimed in claim 6, including the further steps of:

preventing said operational light source from directly or indirectly applying light to said photoelectric detector to cause said photoelectric sensor to place said output signal in said second state;

testing the output of said photoelectric sensor to determine if said output is in said second state; and controlling the state of said binary pass/fail output signal such that the binary pass/fail output signal is in a pass state if the output of said photoelectric sensor is in said second state when the output of said photoelectric sensor is tested and the binary pass/fail output signal is in a fail state if the output of said photoelectric sensor is not in said second state when the output of said photoelectric sensor is tested.

8. The method of testing a photoelectric sensor as claimed in claim 5 including the further steps of:

preventing said operational light source from directly or indirectly applying light to said photoelectric detector to cause said photoelectric sensor to place said output signal in said second state;

testing the output of said photoelectric sensor to determine if said output is in said second state; and controlling the state of said binary pass/fail output signal such that the binary pass/fail output signal is in a pass state if the output of said photoelectric sensor is in said second state when the output of said photoelectric sensor is tested and the binary pass/fail output signal is in a fail state if the output of said photoelectric sensor is not in said second state when the output of said photoelectric sensor is tested.

9. A method of testing a photoelectric sensor that includes at least one operational light source and at least one light detector having, respectively, a light radiation pattern and a field of view aligned with one another for sensing the presence or absence of objects located in both said operational light source light radiation pattern and said light detector field of view and producing an output signal that is in a first state if light is detected by said light detector and a second state if light is not detected by said light detector, said method comprising the steps of:

controlling the output of said light detector so as to cause said photoelectric sensor to place said output signal in said first state if predetermined parts of said photoelectric sensor are operating correctly regardless of whether an object is located in both said operational light source light radiation pattern and said light detector field of view; and preventing said operational light source from directly or indirectly applying light to said photoelectric detector to cause said photoelectric sensor to place said output signal in said second state.

10. The method of testing a photoelectric sensor as claimed in claim 9, wherein said output of said light detector is controlled to cause said photoelectric sensor to place said output signal in said first state only if said operational light source is capable of emitting light.

11. The method of testing a photoelectric sensor as claimed in claim 9, wherein the step of controlling the output of said light detector so as to cause said photoelectric sensor to place said output signal in said first state comprises applying a test light to said light detector.

12. The method of testing a photoelectric sensor as claimed in claim 11, wherein said test light is applied to said light detector to cause said photoelectric sensor to place said output signal in said first state only if said operational light source is capable of emitting light.

13. In a photoelectric sensor that includes at least one operational light source and at least one light detector having, respectively, a light radiation pattern and a field of view aligned with one another for sensing the presence or absence of objects located in both said operational light source light radiation pattern and said light detector field of view and producing an output signal that is in a first state if light is detected by said light detector and a second state if light is not detected by said light detector, the improvement comprising:

(a) ON TEST means for controlling the output of said light detector so as to cause the output of said photoelectric sensor to achieve said first state; and (b) control means connected to said ON TEST means and to said photoelectric sensor for causing said ON TEST means to control the output of said light detector so as to cause the output of said photoelectric sensor to achieve said first state if predetermined parts of said photoelectric sensor are operating correctly regardless of whether an object is located in both said operational light source light radiation pattern and said light detector field of view.

14. The improvement claimed in claim 13, wherein said control means also; (i) tests the output of said photoelectric sensor to determine the state of said output when said ON TEST means is controlling the output of said light detector; and (ii) produces a binary pass/fail signal, said binary pass/fail signal being in a pass state if said output is in said first state when said ON TEST means is controlling the output of said light detector and in a fail state if said output is in said second state when said ON TEST means is controlling the output of said light detector.

15. The improvement claim in claim 14, wherein said control means also:

(a) prevents said operational light source from emitting light;

(b) tests the output of said photoelectric sensor to determine the state of said output when said operational light source is prevented from emitting light; and (c) controls the state of said binary pass/fail signal such that said binary pass/fail signal is in a pass state if said output is in said second state when said operational light source is prevented from emitting light and is in a fail state if said output is in said first state when said operational light source is prevented from emitting light.

16. The improvement claimed in claim 15, wherein said control means allows said ON TEST means to control the output of said light detector so as to cause the output of said photoelectric sensor to achieve said first state only if said operational light source can emit light when energized.

17. The improvement claimed in claim 16, wherein said operational light source comprises a plurality of semiconductor light-emitting devices and said light detector comprises a corresponding plurality of semiconductor light-detecting devices.

18. The improvement claimed in claim 13, wherein said ON TEST means includes a test light source positioned to apply light to said light detector.

19. The improvement claimed in claim 18, wherein said test light source is a semiconductor light-emitting device.

20. The improvement claimed in claim 19, wherein said control means includes a first semiconductor switch connected in circuit with said test semiconductor light-emitting device for controlling the passing of current through said test semiconductor light-emitting device and, thus, the emission of light by said test semiconductor light-emitting device.

21. The improvement claimed in claim 20, wherein said control means includes a second semiconductor switch connected in circuit with said first semiconductor switch for allowing power to flow through said test semiconductor light-emitting device only if current can flow through said operational light source.

22. The improvement claimed in claim 21, wherein said control means includes a third semiconductor switch connected in circuit with said operational light source for controlling the flow of current through said light source.

23. The improvement claimed in claim 18, wherein said control means includes a first switch connected in circuit with said test light source for controlling the passing of current through said test light source and, thus, the emission of light by said test light source.

24. The improvement claimed in claim 23, wherein said control means includes a second switch connected in circuit with said first switch for allowing power to flow through said test source only if current can flow through said operational light source.

25. The improvement claimed in claim 24, wherein said control means includes a third switch connected in circuit with said operational light source for controlling the flow of current through said operational light source.

26. The improvement claimed in claim 13, wherein said control means includes a first switch connected in circuit with said light detector for controlling the output of said light detector so as to cause the output of said photoelectric sensor to achieve said first state.

27. The improvement claimed in claim 26, wherein said ON TEST means includes a test light source positioned to apply light to said light detector.

28. The improvement claimed in claim 27, wherein said first switch is connected in circuit with said test light source for controlling the passing of current through said test light source and, thus, the emission of light by said test light source.

29. The improvement claimed in claim 28, wherein said control means includes a second switch connected in circuit with said first switch for allowing power to flow through said test light source only if current can flow through said operational light source.

30. The improvement claimed in claim 29, wherein said control means includes a third switch connected in circuit with said operational light source for controlling the flow of current through said operational light source.

31. In a photoelectric sensor that includes at least one operational light source and at least one light detector having, respectively, a light radiation pattern and a field of view aligned with one another for sensing the presence or absence of objects located in both said operational light source light radiation pattern and said light detector field of view and producing an output signal that is in a first state if light is detected by said light detector and a second state if light is not detected by said light detector, the improvement comprising:

(a) ON TEST means for controlling the output of said light detector so as to cause the output of said photoelectric sensor to achieve said first state; and (b) control means connected to said ON TEST means and to said photoelectric sensor for:

(i) causing said ON TEST means to control the output of said light detector so as to cause the output of said photoelectric sensor to achieve said first state if predetermined parts of said photoelectric sensor are operating correctly regardless of whether an object is located in both said operational light source light radiation pattern and said light detector field of view; and (ii) preventing said operational light source from emitting light and causing the output of said photoelectric sensor to achieve said second state.

32. The improvement claimed in claim 31, wherein said control means allows said ON TEST means to control the output of said light detector so as to cause the output of said photoelectric sensor to achieve said first state only if said operational light source can emit light when energized.

33. The improvement claimed in claim 32, wherein said ON TEST means includes a test light source position to apply light to said light detector.

34. The improvement claimed in claim 33, wherein said control means allows said test light source to emit light only if said operational light source can emit light when energized.

35. The improvement claimed in claim 34, wherein said operational light source comprises a plurality of semiconductor light-emitting devices and said light detector comprises a corresponding plurality of semiconductor light-detecting devices.

36. The improvement claimed in claim 33, wherein said test light source is a semiconductor light-emitting device.

37. The improvement claimed in claim 36, wherein said control means includes a first semiconductor switch connected in circuit with said test semiconductor light-emitting device for controlling the passing of current through said test semiconductor light-emitting device and, thus, the emission of light by said test semiconductor light-emitting device.

38. The improvement claimed in claim 37, wherein said control means includes a second semiconductor switch connected in circuit with said first semiconductor switch for allowing power to flow through said test semiconductor light-emitting device only if current can flow through said operational light source.

39. The improvement claimed in claim 38, wherein said control means includes a third semiconductor switch connected in circuit with said operational light source for controlling the flow of current through said operational light source.

40. The improvement claimed in claim 31, wherein said control means includes a first switch connected in circuit with said light detector for controlling the output of said light detector so as to cause the output of said photoelectric sensor to achieve said first state.

41. The improvement claimed in claim 31, wherein said ON TEST means includes a test light source positioned to apply light to said light detector.

42. The improvement claimed in claim 41, wherein said control means includes a first switch connected in circuit with said test light source for controlling the passing of current through said test light source and, thus, the emission of light by said test light source.

43. The improvement claimed in claim 42, wherein said control means includes a second switch connected in circuit with said first switch for allowing power to flow through said test light source only if current can flow through said operational light source.

44. The improvement claimed in claim 43, wherein said control means includes a third switch connected in circuit with said operational light source for controlling the flow of current through said operational light source.

* * * * *

UNITED STATES PATENT AND TRADEMARK OFFICE

CERTIFICATE OF CORRECTION

PATENT NO. : 4,990,895

DATED : February 5, 1991

INVENTOR(S) : Scott M. Juds

It is certified that error appears in the above-identified patent and that said Letters Patent is hereby corrected as shown below:

| Column | Line | |
|---|---|---|
| 10 | 22 | After "light" insert --source light--. |
| 12 | 57 | Delete "also;" and insert therefor --also;--. |
| 12 | 67 | Delete "claim" (first occurrence) and insert therefor --claimed--. |
| 13 | 57 | After "test" insert --light--. |

Signed and Sealed this

Third Day of November, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,990,895

DATED : February 5, 1991

INVENTOR(S) : Scott M. Juds

It is certified that error appears in the above-identified patent and that said Letters Patent is hereby corrected as shown below:

| Column | Line | |
|---|---|---|
| 6 | 12 | Delete "B-PD6A" and insert therefor --B - PD6A-- |
| 6 | 30 | Delete "B-PD6A" and insert therefor --B - PD6A-- |
| 6 | 39 | Delete "B-PD6A" and insert therefor --B - PD6A-- |
| 6 | 41 | Delete "B-PD6A" and insert therefor --B - PD6A-- |

Signed and Sealed this

Fifth Day of January, 1993

*Attest:*

*Attesting Officer*

DOUGLAS B. COMER

*Acting Commissioner of Patents and Trademarks*